United States Patent [19]

Loomis

[11] 3,984,952

[45] Oct. 12, 1976

[54] GAUGE PANEL STRUCTURE FOR ELEVATOR SHAFT ROUGH ENTRANCE OPENING

[76] Inventor: Charles M. Loomis, P.O. Box 453, Arkansas City, Kans. 67005

[22] Filed: Nov. 28, 1975

[21] Appl. No.: 635,915

[52] U.S. Cl. ..... 52/127; 33/85; 33/194; 52/30; 52/204; 52/749

[51] Int. Cl.[2] ..... E06B 1/04; B66B 13/30; E04G 21/18

[58] Field of Search ..... 52/204, 205, 211, 173, 52/749, 127, 30; 33/85, 194

[56] References Cited

UNITED STATES PATENTS

| | | | |
|---|---|---|---|
| 2,914,812 | 12/1959 | Christian et al. | 52/127 |
| 3,686,808 | 8/1972 | Loomis | 52/211 |
| 3,740,907 | 6/1973 | Loomis | 52/205 |

FOREIGN PATENTS OR APPLICATIONS

| | | | |
|---|---|---|---|
| 901,210 | 10/1944 | France | 52/204 |
| 1,048,718 | 12/1953 | France | 52/749 |
| 1,684,230 | 10/1969 | Germany | 52/749 |
| 700,428 | 12/1953 | United Kingdom | 52/749 |
| 1,127,013 | 9/1968 | United Kingdom | 52/749 |

*Primary Examiner*—Alfred C. Perham
*Attorney, Agent, or Firm*—Willis Bugbee

[57] ABSTRACT

A rectangular main frame has uprights resting upon and bolted to a shelf formed by a horizontal angle beam or corbel installed in the elevator shaft or hatchway below the floor level and at the intended location for the corridor entrance wall opening into the elevator shaft. Extending between the upper ends of the uprights is a top hanger header which subsequently supports the trackway for the corridor entrance door or doors. Also secured to the angle member is a corridor entrance sill support having secured thereto spaced parallel channel brackets projecting outward therefrom and containing pairs of keyhole slots in their vertical webs. A rigid rectangular gauge panel having external dimensions slightly greater than the external dimensions of the finished entrance opening structure is bolted to vertical legs adapted to rest temporarily on the rough corridor floor and also bolted to horizontal lower bent arms which in turn are secured to the channel brackets by bolts and studs adapted to fit into the keyhole slots. The gauge panel also has extensible upper forward angle arms which are bolted to slotted upper angle arms which in turn are bolted to the main frame. After the wall masonry has been completed up to the gauge panel, the gauge panel structure is removed, whereupon the finished entrance opening structure is slid into place with the heads of its bolts and studs inserted through the enlarged ends of the keyhole slots and their shanks then moved into the narrowed portions of the keyhole slots and permanently but removably secured by tightening the bolts.

10 Claims, 5 Drawing Figures

GAUGE PANEL STRUCTURE FOR ELEVATOR SHAFT ROUGH ENTRANCE OPENING

BACKGROUND OF THE INVENTION

Hitherto, architects in their drawings of corridor walls adjacent elevator shafts of buildings have assigned dimensions to the rough opening into which the finished entrance opening structure or framework is subsequently installed. Frequently the corridor wall opening constructed by following these dimensions has left inadequate clearances between the edges of the opening and the finished entrance opening framework for the elevator-installing workmen to insert their wrenches and other tools. This prior procedure also has consumed an excessive amount of time in custom-building the elevator shaft and entrance openings thereto and requires constant vigilance on the part of the masons and foremen to insure that these rough openings are neither too large nor too small. Furthermore, the installation of the entrance framework into the rough opening has incurred damage to this finished framework by workmen passing through the entrance opening, such as by their wheelbarrows scraping the finished metal work.

SUMMARY OF THE INVENTION

The present invention provides a precisely-dimensioned rigid gauge panel structure which predetermines the exact size for the rough entrance opening and consequently predetermines the exact size for the finished entrance opening structure of the elevator shaft to be subsequently installed therein. When installed in the desired location for the elevator shaft opening, the rigid panel of this gauge panel structure enables the building contractor's mason to build the corridor wall up to the edges of the gauge panel. This rigid gauge panel cannot be accidentally bent or flexed out of shape to alter the intended size and shape of the rough entrance opening, and provides the necessary clearance in the rough opening in the elevator shaft or hatchway wall into which the finished elevator entrance opening structure may be subsequently slid and bolted in permanent position. This main frame is disclosed and claimed in my U.S. Pat. No. 3,686,808, issued Sept. 29, 1972, for Door Frame, Sill and Facia Construction for Elevator Shaft Entrances. The present invention is an improvement on the gauge frame disclosed and claimed in my U.S. Pat. No. 3,740,907, issued June 26, 1973, for Gauge Frame for Elevator Shaft Entrance Opening, and also enables the installation of the finished entrance opening structure to be deferred until after the building contractor's masons and other workmen have completed their work, with the result of preventing damage to that entrance opening structure. This rigid gauge panel makes it possible to control the dimensions of the corridor wall both as to the size of the rough opening into the elevator shaft and the thickness of the corridor frame, so as to guarantee a precise fit of the finished elevator entrance opening structure subsequently installed after the corridor wall has been completed. It also serves as a safety barrier which effectively prevents anyone from accidentally walking through the rough entrance opening and falling into the elevator shaft or hatchway.

Figure 1:
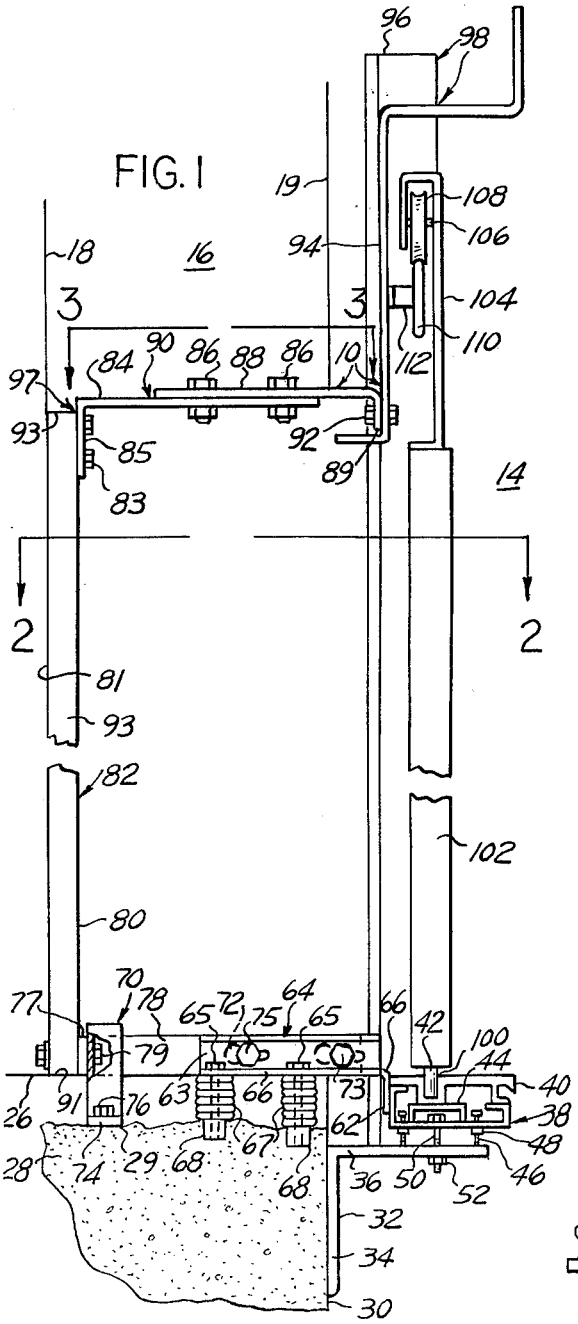
FIG. 1 is a side elevation, centrally broken away to conserve space, of a gauge panel structure attached to a main frame installed at an elevator shaft entrance opening, according to one form of the invention, with the locations of the outer and inner surfaces of the corridor wall indicated by dashed lines.

Referring to the drawings in detail, FIG. 1 shows an entrance opening frame and gauge panel structure assembly, generally designated 10, for installation in a rough entrance opening 12 of an elevator shaft or hatchway 14 having a building corridor wall 16 intended to ultimately possess a finished outer surface 18 and an inner surface 19. The entrance opening 12 has a bottom surface 26 (FIG. 1) which is the finished upper surface of the concrete building floor 28, which temporarily has a rough floor surface 29. Secured to the vertical wall surface 30 of the elevator shaft or hatchway 14 adjacent the building floor 28 is a horizontal sill-supporting angle member 32 having a vertical flange 34 and a horizontal flange 36 forming a shelf. The vertical flange 34 is secured to the inner surface 30 of the floor 28 while the horizontal flange 36 carries an upwardly-facing channel-shaped sill support 38 which, as its name signifies, in turn supports the entrance door sill 40. The sill 40 contains one or more door guide grooves 42.

Welded or otherwise suitably secured to the web of the sill support 38 is an inverted channel member 44 upon which the entrance sill 40 rests. The sill support 38 is adjustably mounted on the horizontal flange 36 of the angle member 32 by a pair of adjusting cap screws 46 mounted at each of the opposite ends of the sill support 38 and threaded through nuts 48 welded or otherwise fixedly secured in spaced parallel relationship in the web of the sill support 38. The inverted channel member 44 midway between the cap screws 46 of each pair is drilled for the passage of a bolt 50, the lower end of which passes through the correspondingly-drilled horizontal flange 36 of the angle member 32 and is locked in position by a nut 52 threaded on the lower end of each bolt 50. As a consequence, by loosening the nut 52 and rotating the cap screws 46 by means of a suitable wrench (not shown), the sill support 38 and consequently the sill 40 can be raised or lowered as desired.

Secured at right angles to the sill support 38 in laterally-spaced parallel relationship are the downwardly-bent inner arms 62 (FIG. 1) of the horizontal flanges 66 of two channel elbow brackets 64. The vertical flanges 63 of the channel elbow brackets 64 are provided with pairs of horizontally-spaced keyhole slots 72 (FIG. 1). Hold-down bolts 65 pass through the horizontal flanges 66 and shims 67 into internally-threaded inserts 68 in the concrete floor 28 below the rough floor surface 29. Angle-section legs 70 and **70*a* have oppositely-bent feet 74 and 74*a* (FIGS. 1, 2, 4 and 5**) similarly bolted at 76 to the floor 28 and have vertical adjustment slots 69 therein.

Figure 2:
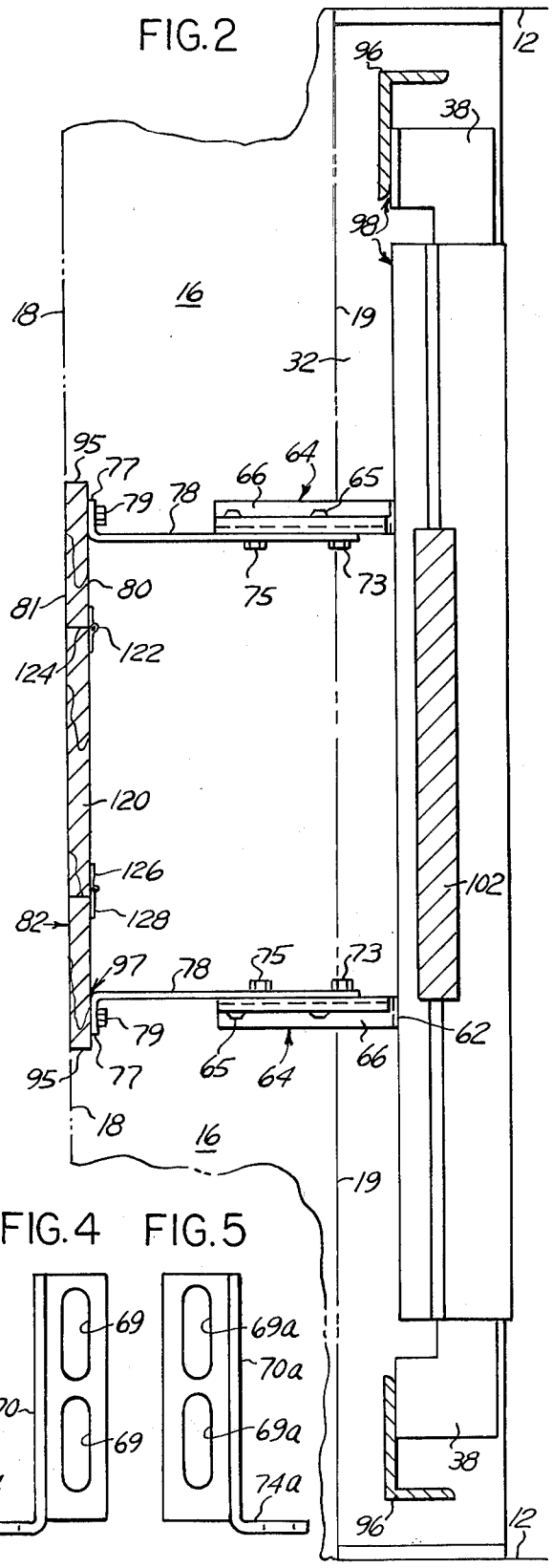
FIG. 2 is a horizontal section taken along the line 2—2 in FIG. 1 through the gauge panel structure of FIG. 1, as installed in a rough opening in an elevator shaft.
Figures 4, 5:
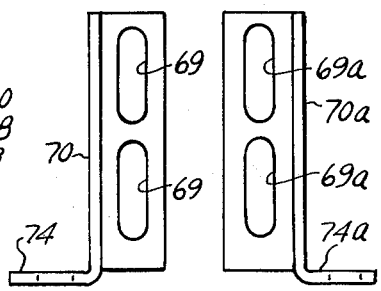
FIG. 4 is an elevation of the right-hand gauge panel supporting leg, upon an enlarged scale, looking in the direction of the arrows 4—4 in FIG. 1.
FIG. 5 is an elevation similar to FIG. 4, but of the left-hand gauge panel supporting leg.

Secured as by headed studs 73 and bolts 75 through the keyhole slots 72 in the two channel elbow brackets 64 are two lower forward adjustable bent arms 78, the bent forward ends 77 of which extend horizontally away from one another. The ends 77 are secured by bolts 79 passing through the slots 69 in the legs 70 and 70*a* to the bottom of the back face 80 of a ridge rectangular corridor wall opening gauge panel 82 of plywood or other suitable material having a front face 81. Similarly secured by bolts 83 to the top of the back face 80 of the gauge panel 82 are the downwardly-extending bent forward ends 85 of two upper forward bent arms 84 (FIG. 3) which are adjustably bolted as at 86 to elongated slots 87 in upper rearward bent arms 88. The two bent arms 84 and 88 collectively constitute an adjustable upper bracket 90. The downwardly-bent rearward ends 89 of the upper rearward bent arms 88 are bolted as at 92 to the lower portion of a hanger header 94, the opposite ends of which are welded or otherwise secured to the upper ends of angle uprights or struts 96 (FIGS. 1 and 2). The gauge panel 82 has lower and upper edges 91 and 93 and opposite side edges 95. The gauge panel 82, the lower forward bent arms 78 and the adjustable upper brackets 90 collectively form the gauge panel structure, generally designated 97, of the present invention. In practice, the gauge panel may be about 2 inches wider and 1 inch higher than the finished entrance opening of the elevator shaft to give a one inch clearance at the sides and top of that opening for the insertion of the finished corridor entrance opening structure.

Figure 3:
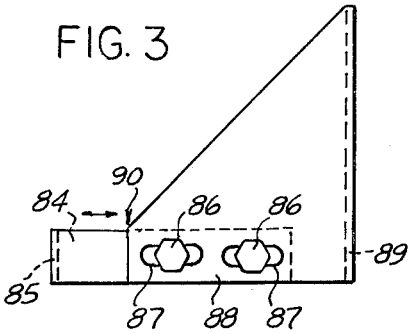
FIG. 3 is a top plan view of one of the upper adjustable brackets, looking in the direction of the arrows 3—3 in FIG. 1.

The opposite ends of the hanger head 94 are welded or otherwise secured to the upper ends of angle uprights or struts 96 (FIGS. 2 and 3). The lower ends of the struts 96 rest upon and are bolted or otherwise secured to the angle beam 32 or to the similarly-located poured-concrete corbel (not shown) constituting with the sill support 38 the horizontal base structure. The hanger header 94, angle struts 96 and angle beam 32 (FIG. 1) or corbel (if substituted therefor) and sill support 38 constitute a main rectangular entrance frame, generally designated 98, to which the gauge panel structure 97 is bolted by its upper brackets 90, and lower arms 78 to the channel brackets 64.

The entrance sill groove 42 slidably receives nylon plastic guide pins or gibs 100 projecting downward from the elevator shaft entrance doors 102. Secured to the upper edges of the doors 102 are approximately C-shaped or reversely-bent brackets 104 in which are mounted axles 106. The axles 106 rotatably support grooved wheels or sheaves 108 which roll to and fro along a door-supporting track 110 supported on arms 112 which are in turn secured to the hanger header 94.

An entrance door 120 (FIG. 2) may optionally be installed on hinges 122 in a doorway 124 through the gauge panel 82 and adapted to be secured by a latch bolt 126 and keeper 128 locked and unlocked from the direction of the shaft or hatchway 14 for controlled passage through the gauge panel 82.

Before installation of the gauge panel structure 97, the sill-supporting angle beam 32 or poured-concrete corbel has already been installed in the elevator shaft or hatchway 12 and bolted to or poured integrally with the surface 30 of the elevator shaft wall 22 adjacent the floor 28, as the case may be. The angle struts 96 and hanger header 94 of the main frame 98 are then erected at the location where the corridor entrance opening 12 is to be situated in the not-yet-constructed building corridor wall 16. The feet 74 of the legs 70 and 70*a* are then secured by the bolts 76 to the floor 28 at the rough floor surface 29 or at the finished floor surface 26 if already in place. The sill support 38 and the channel brackets 64 secured thereto are now caused to rest upon and be secured to the upper flange 36 of the angle beam 32 or poured-concrete corbel, if used. The channel brackets 64 are then secured by bolts 65 and shims 67 to the inserts 68 below the rough surface 29 of the floor 28. The hanger header 94 is bolted or otherwise secured to the vertical surface 30 of the elevator shaft wall 22 adjacent the floor 28 above the floor 28 on which the elevator shaft entrance main frame 98 is being installed. The gauge panel structure 95 is then brought into its intended position with the rigid gauge panel 82 positioned where the rough entrance opening 12 is desired to be located and its front face 81 positioned where the outer surface of the corridor wall is intended to be placed. The gauge panel structure 95 is then temporarily fixed in this position by inserting the studs 73 and bolts 75 and the bolts 92 respectively securing the forward lower bent arms 78 to the channel brackets 64 and the adjustable upper brackets 90 to the hanger head 94. The elevator shaft walls 22 and corridor walls 16 are then erected by the masons and brought up to the vertical side edges 93 of the gauge panel 82 and their lintel portions extended down to the horizontal top edge 93 of the gauge panel 82 while the shaft walls 22 are terminated adjacent the ends of the sill supports 28 and angle members 32. Construction then goes on until the masonry and other rough work has been completed. The gauge panel structure 95 is then detached from the main frame 98 by withdrawing the studs 73, bolts 75 and bolts 92 from their respective holes, whereupon the gauge panel structure 97 is then slid rearwardly and removed.

The finished entrance doorway structure (not shown) is now ready to be installed in the opening 12. It is brought into alignment with the inner edges of the channel brackets 64 and slid inward until the heads of its bolts and studs (not shown) arrive opposite the enlargements of the keyhole slots 72 in the channel brackets 64 whereupon these heads are pushed through the enlargements. The entire finished entrance opening structure is then pushed inward bodily until the shanks of its bolts and studs arrive at the inner ends of the narrow portions of the keyhole slots 72. The workmen then tighten these bolts and the finished entrance opening structure is thus installed in its final position, without the danger of damage to it by accidents which might otherwise have previously occurred had it been installed earlier without the use of the gauge panel structure 95.

I claim:

1. A gauge panel structure adapted to be mounted on a building corridor floor adjacent the entrance opening of an elevator shaft having an entrance opening frame secured in the entrance opening and adapted externally for precisely locating the outer face of an adjacent building corridor wall together with the opposite side surfaces and top surface of the intended wall opening, said gauge panel structure comprising a corridor-wall-opening gauge panel having a peripheral outline corresponding generally to the outline of the intended entrance opening, said panel having a bottom edge surface adapted to rest upon the building corridor floor, side edge surfaces adapted to serve as delimiting abutments for the laying up of the corridor wall on opposite sides of the entrance opening, and a top edge surface adapted to serve as a limiting abutment for the corridor wall above the entrance opening, lower panel-positioning means secured to the lower portion of said gauge panel and extending rearwardly therefrom and adapted to be secured to a lower portion of the entrance opening frame, and upper panel-positioning means secured to the upper portion of said gauge panel and extending rearwardly therefrom and adapted to be secured to an upper portion of the entrance opening frame.

2. A gauge panel structure, according to claim 1, wherein said lower panel-positioning means includes a pair of lower arms disposed in laterally-spaced relationship.

3. A gauge panel structure, according to claim 2, wherein said lower arms include extensible and retractible components adapted respectively to lengthen and shorten the distance of the bottom portion of said gauge panel from the entrance opening frame.

4. A gauge panel structure, according to claim 1, wherein said upper panel-positioning means includes a pair of upper arms disposed in laterally spaced relationship.

5. A gauge panel structure, according to claim 4, wherein said upper arms include extensible and retractible components adapted respectively to lengthen and shorten the distance of the top portion of said gauge panel from the entrance opening frame.

6. A gauge panel structure, according to claim 1, wherein said gauge panel comprises a substantially flat plate.

7. A gauge panel structure, according to claim 6, wherein said substantially flat plate is a substantially rectangular plate.

8. A gauge panel structure, according to claim 6, wherein said gauge is of material which is substantially unyielding to force applied against said plate substantially in the plane of said plate.

9. A gauge panel structure, according to claim 1, wherein said lower and upper panel-positioning means comprise lower and upper arms disposed in laterally-spaced parallel relationship with one another.

10. A gauge panel structure, according to claim 7, wherein said lower and upper panel-positioning means comprise lower and upper arms connected respectively to the lower and upper corner portions of said rectangular plate.

* * * * *